United States Patent [19]

Spanel

[11] 3,937,156

[45] Feb. 10, 1976

[54] METHOD AND MEANS OF TUFTING

[76] Inventor: Abram N. Spanel, 344 Stockton St., Princeton, N.J. 08540

[22] Filed: Nov. 27, 1973

[21] Appl. No.: 419,417

Related U.S. Application Data

[63] Continuation of Ser. No. 239,931, March 31, 1972.

[52] U.S. Cl. ..... 112/79 FF; 83/100; 83/402; 112/266

[51] Int. Cl.[2] ..... D05C 15/16

[58] Field of Search ..... 112/79 R, 79 A, 79 FF, 112/79.5, 252, DIG. 1, DIG. 2, DIG. 3, 262, 266; 83/100, 402

[56] References Cited

UNITED STATES PATENTS

| | | | |
|---|---|---|---|
| 2,866,424 | 12/1958 | Masland | 112/79 FF |
| 3,103,903 | 9/1963 | Broadrick et al. | 112/79 R |
| 3,220,371 | 11/1965 | Short et al. | 112/79 R X |
| 3,387,577 | 6/1968 | Spanel et al. | 112/79 R |
| 3,595,186 | 7/1971 | Shorrock | 112/79 R |
| 3,756,173 | 9/1973 | Shorrock | 112/79 FF |

*Primary Examiner*—H. Hampton Hunter
*Attorney, Agent, or Firm*—Steele & Petock

[57] ABSTRACT

A tufting machine having multi-color selection capability for each tufting cycle which utilizes pneumatic pressure either positive or negative, or a combination of the two, to transfer the yarn or other tufting material to tufting elements, the yarn being severed before, during, or after threading, for subsequent placement into tufting relationship with a backing layer. The system comprises yarn guide passageways having abutting sections which are relatively movable to create an opening through which a yarn-severing means severs the yarn into selectively-sized bits. The relative positions of the yarn-severing means and the abutting sections of the passageways are adjustable to provide yarn bits of selected varying lengths. Clamping means may be used to clamp the yarn at the tufting needles until tufting occurs. After tufting the tufted yarn is moved away from the needle position to avoid entanglement by the succeeding motions of the tufting.

29 Claims, 13 Drawing Figures

METHOD AND MEANS OF TUFTING

CROSS REFERENCE TO RELATED APPLICATIONS

This application is a continuation of my earlier application Ser. No. 239,931, filed Mar. 31, 1972 entitled "Method and Means of Tufting."

BACKGROUND OF THE INVENTION

1. Field of the Invention

The present invention relates to tufting of rugs, carpets and the like and utilizes a pneumatic system which may be used in various types of tufting systems, however, it has particular utility in the Spanel et al multi-color selection system described below.

2. Prior Art

The present invention offers modifications to some embodiments disclosed in U.S. Pat. No. 3,554,147 which issued to Abram N. Spanel and George J. Brennan on Jan. 12, 1971 and U.S. Pat. No. Re 27,165 which issued Aug. 10, 1971 to Abram N. Spanel and Loy E. Barton, Abram N. Spanel being the inventor of the subject matter of the present application.

U.S. Pat. No. Re 27,165 discloses a pneumatic system in which yarn strands and/or discrete bits of yarn are transported pneumatically to a loading station where they are applied by a bit-applying element to the backing layer. Here, multi-color selection of yarn bits is enabled by a magazine thus offering a varied color selection to each of the guide tubes through which yarn is transported to the bit-applying elements in their loading position.

The aforementioned U.S. Pat. No. 3,554,147 shows an alternative system to U.S. Pat. No. Re 27,165 which provides for the simultaneous selection of bit-lengths of yarn of different colors for each tufting cycle at each individual needle station. This is accomplished by having yarn from as many sources of color as desired fed through channels which lead into a common channel adjacent the loading station. The capability of cutting a bit-length of yarn before, during or after threading of the bit-applying means and before or during tufting is disclosed. Since the cutting function may take place in close proximity to the loading station and after a particular yarn strand has been fed into the common channel, U.S. Pat. No. 3,554,147 discloses a pull-back system to remove at will, the strand of yarn from the common channel leading to the loading station when a color change is desired.

The system disclosed in some embodiments of aforementioned U.S. Pat. No. 3,554,147, wherein yarn was severed into yarn bits while in tubes or channels when under the influence of pneumatic pressure, was found lacking in some aspects when employed with multi-color selection systems. Accordingly, it is one of the objectives of this invention to provide for increased utility when so employed, as will be clear from the following. To admit a cutting element into pneumatic passageway, it is necessary to have an opening through which the cutting element may operate. This very opening will diminish the efficiency of the pneumatic system, if allowed to remain open during the transport of the yarn. Further, in the Spanel et al multi-color, cut-pile systems, it is desirable to have cutting means adjustable to produce variable pile heights in the manufactured rugs, such adjustment tending to also diminish pneumatic efficiency.

Pneumatic tufting systems such as contained in U.S. Pat. No. 3,216,387 issued Nov. 9, 1965, U.S. Pat. No. 3,217,675 issued Nov. 16, 1965 and U.S. Pat. No. 3,386,403 issued June 4, 1968, all to Joe T. Short, are directed to continuous tufting methods without the multi-color capability of changing yarns prior to each tufting cycle. Such system do not provide a cutting-before-tufting operation comparable to that disclosed in the Spanel et al systems.

U.S. Pat. No. 3,389,667 which issued June 25, 1968 to Helmet C. Mueller discloses the transportation of yarn by positive pressure through hollow needles which are similar to those used in the Short patents and are to be distinguished from the Spanel et al needles which are not hollow and are transversely threaded through needle eyes. Mueller cuts the yarn while it is still in the hollow tube-like needle, and further he neither shows nor teaches a means to prevent pneumatic pressure loss at the cutting station.

The Stanley Shorrock U.S. Pat. No. 3,595,186 issued July 27, 1971 also discloses the use of hollow needles as do the aforementioned Short and Mueller patents whereas the Spanel tufting systems use needles that clearly are not hollow, and moreover are transversely threaded through needle eyes.

Furthermore, Shorrock's arrangement is dependent upon a combination of mechanical and pneumatic feeding means whereas the Spanel et al system utilizes solely pneumatic feeding means.

Also, Shorrock provides yarn bits of uniform length and does not show nor teach the capability to provide variable lengths of yarn bits as is clearly and fully disclosed in the teachings of Spanel in the present application.

A need is thus present for an integrated, highly efficient system for placing a discrete bit in a loading position relative to a tufting member which includes: cutting the yarn into a yarn bit with a cutting means and preserving the efficiency of the pneumatic system while performing such a cutting function, such means being additionally adjustable to provide yarn bits of varying lengths; improving the efficiency of the pneumatic system at the needle station and at the same time providing means to positively control the yarn before and after tufting.

SUMMARY OF THE INVENTION

Accordingly, it is an object of the present invention to provide a tufting machine with yarn guide passageways which are free of any substantial pneumatic leaks during the transportation of the yarn yet which will permit the yarn to be cut while in the passageways by yarn-severing means to provide discrete bits of yarn.

It is another object of the present invention to provide a tufting machine in which the efficiency of the pneumatic system may be maintained while introducing the ability to control the cutting means to provide yarn bits of different lengths thereby allowing for varying rug pile heights.

Another object of the present invention is to provide a tufting machine in which the flow of the backing is arranged to improve the efficiency of the pneumatic yarn transportation system.

Yet another object of the present invention is to provide a tufting machine with an improved means of positively controlling yarn bits both before and after tufting.

In accordance with the present invention, there is provided a pneumatic tufting machine in which yarn is transported through passageways via pneumatic gas flow and can be cut while in said passageways by an arrangement in which gaps in the passageways are closed during yarn transfer to prevent the loss of pneumatic efficiency and opened for access of the cutting means. In one embodiment, the gap is provided by an axially reciprocable section of the yarn passageway system to provide access openings for the rapid movement of the yarn-severing means across the yarn passageways to cut the yarn into discrete bits. After completion of the cutting operation, and withdrawal of the cutting member, the reciprocable passageway section closes the access opening and the pneumatic system is once again intact for the transportation of the next bit-length of yarn. Both the cutting member and the abutting sections are adjustable in position relative to each other to give the machine the capability of providing yarn bits of varying lengths. To achieve continuous operation with a minimum of shutdowns of the system, a durable long-lasting cutting member is called for and such is provided. Once the yarn has been cut into discrete bits, positive control is continued by a clamping arrangement at each needle station.

Pneumatic efficiency within the system is further increased by the manner in which the backing moves to and from the tufting position. The mechanism utilized is also designed to keep tufted yarn free from yarn entanglement during the next tufting stroke.

BRIEF DESCRIPTION OF THE DRAWINGS

For a more detailed understanding of the invention, reference is made in the following description to the accompanying drawings in which.

DESCRIPTION OF THE PREFERRED EMBODIMENTS

Figure 1:
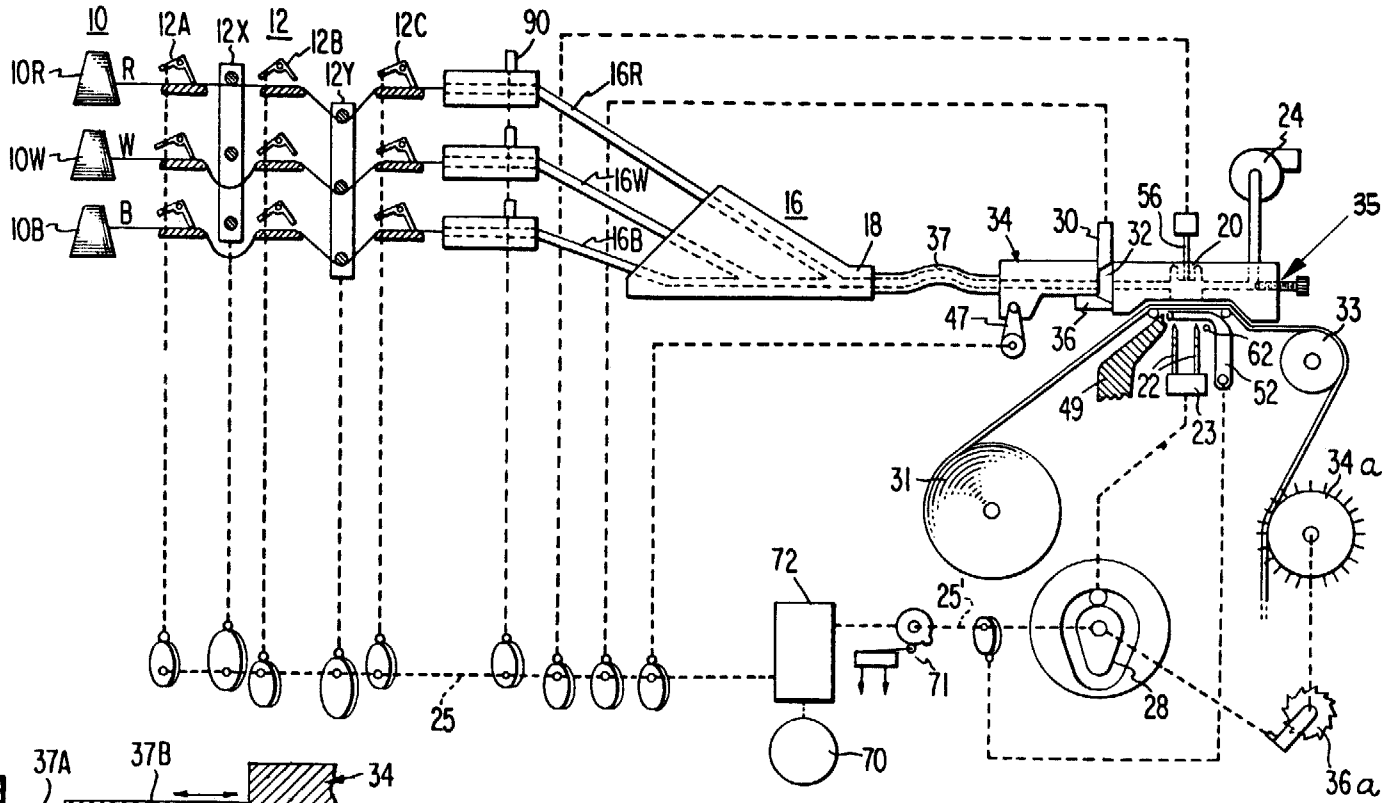
FIG. 1 is a schematic view of a tufting machine.

In general, the subject tufting machine shown in FIG. 1 comprises a creel 10 having three spools 10R, 10W, 10B, each of differently colored yarn, a yarn metering system 12, a collator 16, a cutting station generally denoted by the cutting blade 30 and anvil 36, an axially reciprocating passageway section 34, a loading or needle station 20, a vacuum source 24, and a tuft guiding means comb member 52. The operation of the tufting machine is controlled by cam shafts generally designated by dotted lines 25 and 25' and various camming members located thereon. In the operation of a preferred embodiment of the tufting machine, yarn from a creel is passed through the metering system 12 which releases a specified length of one of the yarns to collator 16 so that it passes by the cutting station and blade 30 to the loading station. At this point, tufting elements shown as needles 22 have been inserted through the backing to be tufted, and up into the loading station. The eyes of needles 22 are aligned with the passage in the loading station 20 so that when the yarn is fed into the loading station 20, it threads needles 22. The metering system 12 operates so that the travel of the yarn into loading station 20 is limited insofar as the portion extending beyond the cutting means 30 is a specified bit-length. When the yarn is in place in loading station 20, it is clamped by the descent of clamping means 56 to prevent lengthwise movement of the yarn bit once cut. Passageway section 34 is reciprocated in a leftward direction by a rocker arm assembly 47 and cutting blade 30 descends against anvil 36 to cut the yarn. After the cutting, the yarn remaining to the left of blade 30 is withdrawn into collator 16 by part 12y of the yarn metering system 12. The withdrawal of the yarn into collator 16 allows a change of color in the yarn, if desired for the next tufting cycle. The yarn on the right which has been cut into a discrete bit is tufted by needles 22 and comb member 52 acts in concert with tuft retaining means 62 to clear the path for the needles during the subsequent tufting operation.

In more detail and again with reference to FIG. 1, creel 10 is shown having three spools 10R, 10W, 10B, respectively providing for example, a supply source of red, white, and blue yarn. While yarn sources for three different colors are shown, it is to be understood that any number of additional yarn colors may be supplied as desired. Also, yarns differing in other than color may be employed.

The yarn strands R, W, and B are led into metering device 12 which comprises a plurality of brakes 12A, 12B, and 12C and yarn pulling devices 12X and 12Y.

Briefly, puller 12Y is shown at the bottom of a stroke with brakes 12A and 12C closed and brake 12B open. In its descent, puller 12Y draws yarn from the left without restraint by opened brake 12B, but is precluded from drawing yarn from creel 10 by closed brake 12A and is precluded from withdrawing yarn from the right by closed brake 12C. Thus, yarn loops formed at the second pulling station by puller 12Y are from yarn temporarily stored at the first pulling station 12X and are available for use when the closed brake 12C is released.

A yarn strand may thus be procured from any of the sources by the release of the brake 12C for the particular strand desired. The remainder of the yarn strand after a bit-length has been removed may be pulled back from the right by closing 12B and actuating yarn puller 12Y. Thus, the yarn metering and feed system has the capability to both supply yarn and to pull part of it back from the pneumatic passageway area 18, 34, 37. For a more detailed description of the yarn feed system and the manner in which colored, pattern-tufting is accomplished, reference should be made to aforementioned U.S. Pat. No. 3,554,147.

For each yarn supply there is a tube or passageway 16R, 16W, and 16B each forming an input passage of collator 16, the tubes of which lead into a common passageway 18 which extends by way of flexible portion 37 and passageway sections 34 and 35 into the needle loading station 20.

Figure 2:
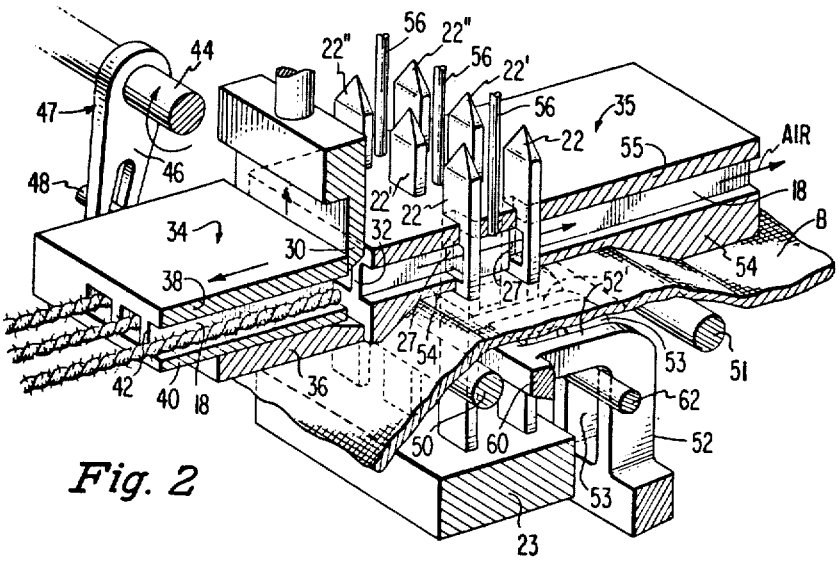
FIG. 2 is an isometric view of the tufting element loading station showing the cutting member gap in open position.

In one embodiment, negative pressure for transporting the yarn strands from yarn-metering device 12 through the collator 16 to loading station 20 may be provided by a pneumatic source 24 shown as a suction device connected to the passageways 18 on the far side of the loading station 20 from the yarn supply to apply a vacuum to the yarn passageways 16, 18, 37. The use of positive pressure or a combination of positive and cooperatively applied negative pressure may be employed to produce a flow of gas to transport the yarn. When double needles 22—22, 22′—22′ and 22″—22″ (FIG. 2 and FIG. 3) are in their threading positions, the eyes of each pair of needles are in alignment with their respective loading passageways, as shown in FIG. 2. Thus, the eyes 27, 27 of double needle 22, 22 are in alignment with common passageway 18.

The row of needles 22 are secured to a needle bar 23, the reciprocation of which may be produced by cam device 28 which is shown operating from shaft 25′. The needle bar 23 and its drive means may be of a conventional design.

The backing feed elements for the backing B include a supply roll 31 an idler roll 33 and a drive roll 34a. A ratchet and pawl mechanism 36a may be used to drive the drive roll 34a intermittently to advance the backing as the tufting is produced by the reciprocation of needles 22.

Motor 70 is shown as driving the entire device through a suitable transmission 72 which may be a train of gears, timing chain, or the like. The metering mechanism 12 is shown as operating from shaft 25. Thus, with clock pulses shown schematically by reference numeral 71 generating a pattern read-out, yarn can be supplied to loading station 20 in the manner more fully described in U.S. Pat. No. 3,554,147.

With reference to FIG. 2, yarn is shown feeding into three of the many loading stations which extend across the width of the tufting machine. The cutting member or knife 30 which operates from shaft 25, FIG. 1, is shown as slightly penetrating into a knife gap or access opening 32 which is between passageway section 34 and passageway loading section 35 (FIGS. 2 and 3) which includes a continuation of passageway 18. Anvil 36 extends beneath part of passageway 18 of passageway section 34 protruding into gap 32 and is aligned with knife member 30. Passageway section 34 which includes both top wall 38 and bottom wall 40 as well as side walls 42 is laterally reciprocable or shiftable as a unit by means of shaft 44 through rocker arm 46 connected to fixed stud 48. This mechanism 47 is shown in FIG. 1 as operating from shaft 25. The access opening 32 may accommodate other cutting means such as oscillating knives or laser cutters, the use of each being contemplated as within the scope of the present invention.

Figure 1A:
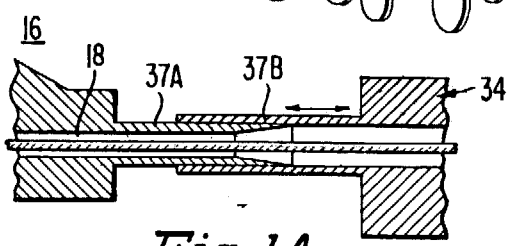
FIG. 1A is a partial sectional view of an alternate embodiment of a portion of FIG. 1.

To permit the axial shifting or reciprocation of section 34, passageway 18 is shown with a flexible portion 37 (FIG. 1). This is relatively straight when the access opening 32 is closed and slacks as section 34 shifts preparatory to the thrust of knife 30. An alternate embodiment to the flexible portion 37 is shown in FIG. 1A in which flexible portion 37 is replaced by telescoping members 37A and 37B. Section 34 is permitted to shift as member 37A slides into member 37B. Although not shown in FIG. 2, and succeeding Figures, the yarn is in guide tubes continually from the collator 16 to the common passageways 18 which are continuous through flexible portion 37, shifting section 34 and needle loading section 35. From its entry into the collator tubes 16R, 16W, and 16B to its placement in section 35, the yarn is under the influence of pneumatic gas flow. The embodiment using, telescoping tubes 37A and 37B (shown in FIG. 1A) permit the increase and decrease in total effective passageway length as section 34 reciprocates.

Intermediate rollers 50 and 51 guide the backing in the proximity of needles 22, 22. A reciprocating comb 52 with apertures 53 for the needles 22 is shown between rollers 50 and 51 to support the backing layer B and may be itself supported by columns (not shown). The comb 52 further serves to drag tufted yarn to the right by means of end bar 60 as the comb 52 shifts to the right to cause the tufts to be retained behind a tuft-retaining bar 62 as will be described. Comb member 52 is shown in FIG. 1 as operating from shaft 25′. The rollers 50 and 51 may be replaced by a shelf or guiding means (not shown) which may project from frame 49 (FIG. 1) and may also serve to raise the level of the backing in the vicinity of the needles. As is shown, bottom wall 54 forming a part of passageway 18 cannot extend between and below the double needles 22, since this space must be clear for a bit of yarn to be drawn into tufting relationship with the backing. Any opening to that space is kept very slight by the close proximity of the backing. The efficiency of the pneumatic flow thus is not significantly lessened by gas leaks which otherwise could interfere with the smooth feeding of the yarn. Yarn clamping devices 56 are designed to hold the bit-lengths of yarn in place once they have been cut by knife 30 despite continued application of pneumatic gas flow. Clamp member 56 is shown in FIG. 1 as operating from shaft 25. To further increase pneumatic efficiency, tolerances resulting in voids between needles 22 and walls of the loading station 35, are kept minimal to minimize gas turbulence. Yarn is only transported into the loading station 35 when the needles 22 are in these loading positions making a substantially streamlined channel, since the needle eyes 27 substantially correspond in size to passageway 18.

Figure 3:
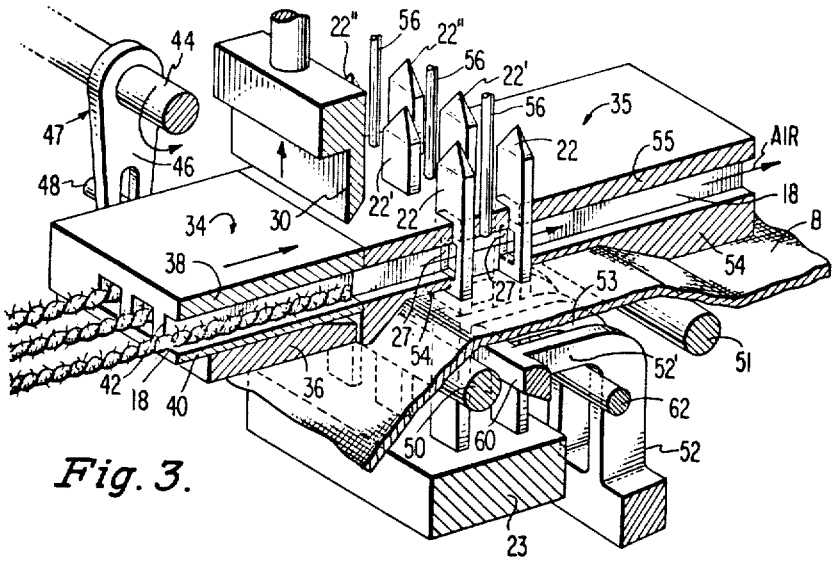
FIG. 3 is an isometric view similar to FIG. 2 except showing the cutting member gap in a closed position.

With reference to FIG. 3, it will be seen that knife gap 32 (which is open in FIG. 2) is closed and axially shifting section 34 abuts against passageway portion 35 effectively closing the system throughout in preparation for the yarn feed.

Figure 4:
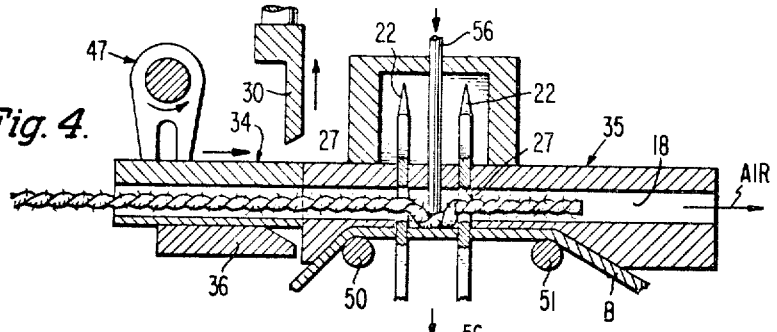
FIG. 4 is a cross-sectional side view of the tufting element loading station showing a bit-length of yarn which has been transported into loading position and clamped.

In operation, a yarn strand of the desired color is chosen by a pattern read-out process which may follow the teaching of aforementioned U.S. Pat. No. 3,554,147 and aforementioned U.S. Pat. No. Re 27,165. The strand is advanced from the yarn-metering device 12 by pneumatic gas flow produced either by positive pressure or negative pressure or a combination of both. The pneumatic gas flow moves the strand through the needle eyes 27 as shown in FIG. 4 with the length being predetermined and set by the yarn-metering device 12 to provide a bit-length of yarn in the loading station area 35 which will provide a discrete bit of the desired length when cut. At a time prior to cutting, clamp member 56 descends to clamp the yarn as shown. Otherwise, when the yarn is cut it could be influenced by the continuing pneumatic gas flow. A yarn-bit stop described subsequently may be used in place of the yarn-clamp member 56. It will be noted that yarn metering device 12 allows the length of yarn to be released so that equal amounts of the yarn extend from the right yarn end to the right member of the double needle as from the left member of the double needle to the cutting means. This is necessary if the pile height is desired to be equal for each leg.

Figure 5:
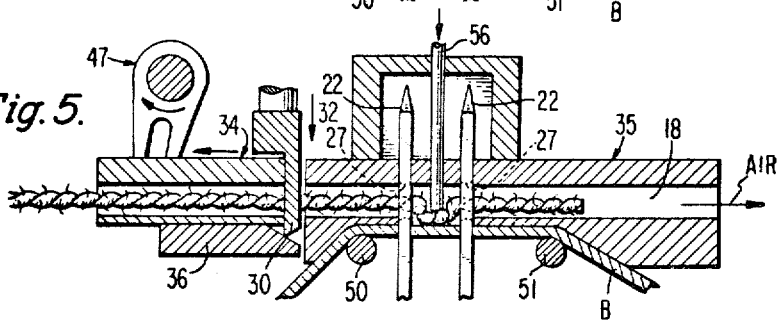
FIG. 5 is a cross-sectional side view of the tufting element loading station showing the cutting of a yarn bit.

When the yarn is in position, reciprocating section 34 shifts to the left to open gap or access opening 32, and knife 30 descends through that gap to make contact with anvil 36 disposed there below as shown in FIG. 5. The yarn is thus effectively severed into a yarn bit in its threaded position.

Figure 6:
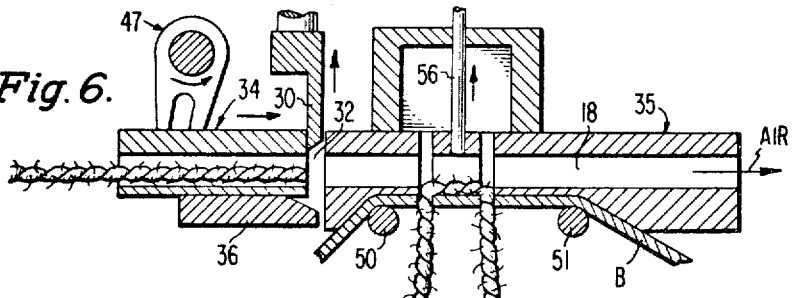
FIG. 6 is a cross-sectional view of the tufting element loading station showing the tufting needles in their down position with the yarn bit deposited in the backing layer.

As needles 22 descend, they pull the yarn bit down through the backing layer placing it in tufting relationship with the backing. At this time the knife 30 may return to removed position, and reciprocating section 34 may shift to the right thereby closing gap 32 in preparation for the next cycle. Needles 22 release the yarn as shown in FIG. 6 and the tufting step is completed. In this position, the tuft legs or ends extend down through apertures 53 (FIGS. 2 and 3) between the teeth 52' of comb member 52 which aids in supporting the backing layer B.

Figure 7:
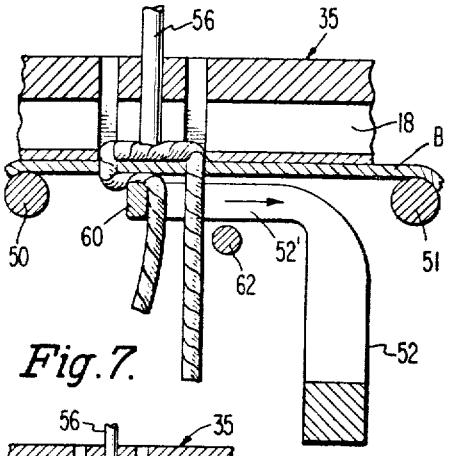
FIG. 7 is a cross-sectional side view of the tufting element loading station showing the comb support member starting its rearward motion (rearward in relation to the tufting station)

With reference to FIG. 7, reciprocating member 52 shifts to the right causing end bar 60 of the comb device 52 to come into contact with the tuft legs.

Figure 8:
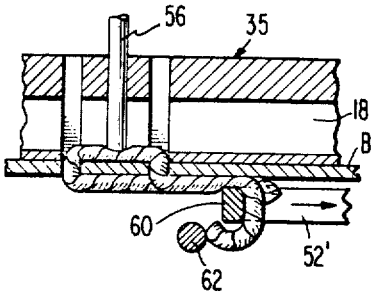
FIG. 8 is a cross-sectional side view of the tufting station and shows a tuft guided to the rear of the tuft retaining bar.

As shown in FIG. 8, both of the tuft legs are pulled by end bar 60 to a point to the right of tuft-retaining bar 62 which is a stationary member positioned downwardly and to the right of the needle tufting station. Once comb device 52 has shifted to its far right position, clamp 56 is released.

Figure 9A:
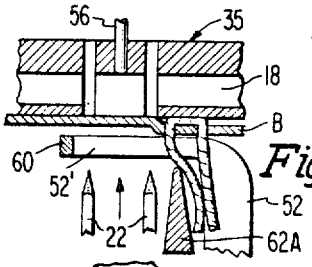
FIG. 9A is a cross-sectional side view similar to FIG. 9, but showing a modified tuft-retaining bar.
Figure 9:
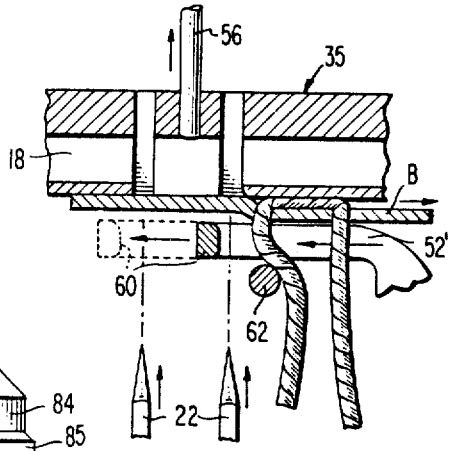
FIG. 9 is a cross-sectional side view similar to FIG. 8, but shows the tuft retained by the tuft retaining bar as the comb support goes forward (here is also shown the backing advanced to its next tufting position)

As seen in FIG. 9, comb member 52 reciprocates back to the left as shown by dotted lines, leaving the tuft legs to the right of tuft-retaining bar 62. At this time, the backing layer B is shifted to the right the distance that is desired for the next tufting cycle. The needles 22 then ascend to their loading position as shown in FIG. 3, and the feeding of the next bit-length of yarn may commence. FIG. 9A shows the tuft-retaining bar 62 of the earlier figures replaced by a preferred wedgeshaped retaining means 62A.

After the yarn bit is severed and in preparation for the next tufting cycle, the yarn color selection process as described in aforementioned U.S. Pat. No. 3,554,147 will select the next yarn color and if change is to be made the yarn strand presently in common passageway 18 from which a yarn bit has just been severed, will be pulled back by the yarn pull-back mechanism 12Y at least far enough to clear the common passageway 18 and the yarn strand from the newly selected color will be fed into the needle loading position through passageway 18.

The machine as described produces cut-pile rugs with the pile heights being determined approximately by the distance that the yarn bit extends on each side of the needles 22, the distance on each side being kept equal if pile legs of the same height are desired. On the other hand, a rug may be obtained which for each needle stroke a short and long pile is produced by setting the yarn-metering device 12 to supply lengths of yarn which will extend a distance beyond needles 22 different than the distance between the cutting member 30 and the needles 22.

Figure 10:
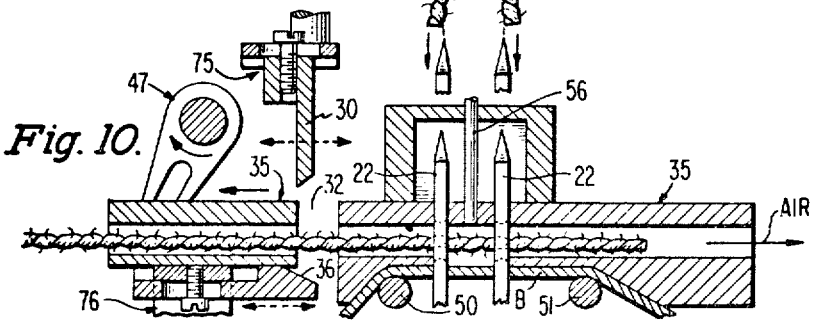
FIG. 10 is a cross-sectional side view of the tufting element loading station showing the cutting machine adjusted to increase at will the length of the yarn bit.
Figure 11:
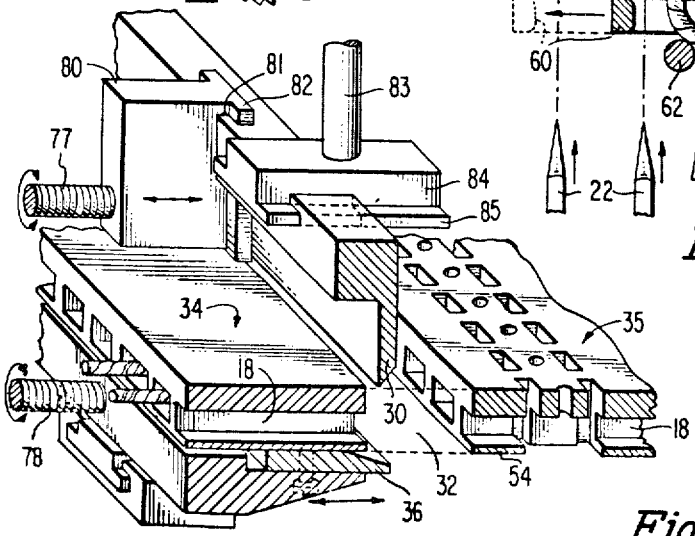
FIG. 11 is an isometric view of the tufting element loading station showing a different means for adjusting the cutting and anvil means.

The tufting machine also may be controlled to produce pile heights that differ from one operation of the machine to the next. With reference to FIG. 10, cutter 30 may be shifted laterally to the left by means of an adjustment means shown generally as 75. An accompanying adjustment means 76 is provided for anvil 36. These are shown as simple screw-set block devices or they may be more on the order of screw means 77 and 78 shown for the cutter 30 and anvil 36 respectively in FIG. 11. As is shown in FIGS. 10 and 11, the shifting block 34 must be set to shift further to the left to create a larger knife gap 32 thereby permitting the knife 30 and anvil 36 contact to be further to the left of loading portion 35 of the passageways 18. Thus, the distance between knife 30 and needle 22 will be increased and yarn-metering device 12 can be set to provide sufficient yarn to give an identical increased length on the far side of needle 22 from the yarn supply. A rug having a greater pile height will thus be produced.

As shown in FIG. 11, screw means 77 is threaded into adjustment block 80 which is inserted into a grooved portion 81 of cutter body 30 by means of base 82 to allow cutter 30 to reciprocate vertically. The reciprocating motion of the cutter may be transferred from shaft 25 (FIG. 1) through shaft 83 and adjustment block 84 locked in place by base 85, but designed to allow cutter 80 to slide lengthwise therealong, to cutter 30. Thus, cutter 30 reciprocates vertically through access opening 32 which separates passageway 18 and may be laterally adjusted by means of screw 77 which is connected to appropriate control means (not shown) to control pile height. A similar lateral adjustment means is provided for anvil 36.

The present system may be modified to have the yarn bits applied adhesively as is disclosed in aforementioned Reissue Patent No. 27,165. A sealing flap valve as shown in FIGS. 23A and 23B of aforementioned U.S. Pat. No. 27,165 may be used to minimize loss of air or other gas.

Advantages may be taken of some of the features of this invention in a further embodiment wherein the yarn is severed at cutting station 90 positioned remotely from the needle loading station and operable from shaft 25 by cam means as shown schematically in FIG. 1. Since in this embodiment, the yarn is cut into bits before the yarn is threaded and is then transported pneumatically to the needle station, it is desirable to have a stop means (not shown) to stop the movement of the yarn bit within the eye of the needle on the order of that which is shown in aforementioned U.S. Pat. No. Re. 27,165. The cutting also can occur during threading which allows additional flexibility in providing yarn bits of varying lengths. In a wellsynchronized operation, the beginning of the yarn strand to be cut is beyond the cutting station when the gap 32 is created for use of the cutting means, thus the yarn transportation is not unduly affected by the gap creation.

While various embodiments of the invention have been shown and described, it will be understood that various modifications may be made. The appended claims are, therefore, intended to define the true scope of the invention.

I claim:

1. In a tufting machine having at least one bit-applying element, pneumatic means including at least one passageway for flow of gas therethrough to deliver a strand of yarn to said bit-applying element, said passageway having a first part shiftable relative to a second part, the method of tufting, comprising the steps of:

applying a flow of gas to said yarn strand to move said strand through said passageway;

shifting said first part of said passageway relative to said second part of said passageway to provide an access opening;

applying a yarn-severing means through said access opening to cut said strand; and closing said access opening by relative shifting of said first part of said passageway relative to said second part of said passageway to render effective said flow of gas.

2. A method of feeding yarn through a passageway extending between a source of yarn and a use-location for the yarn comprising the steps of:

applying a flow of air to transport said yarn through said passageway;

moving a relatively movable structure of said passageway to open and close an access opening; and operating a yarn severing element through said access opening to sever a length of yarn from said source of yarn.

3. In a tufting machine having bit-applying needles; pneumatic means including passageways for flow of gas therethrough to deliver strands of yarn to said needles, said passageways extending to said needles having a first part shiftable relative to a second part; and having yarn-metering devices; the method of applying tufts to a backing layer, comprising the steps of:

metering unsevered bit-lengths of yarn by said yarn-metering devices;

transporting said metered unsevered yarn through said passageways by said pneumatic means into loading positions relative to said needles;

providing access to said passageways for operating therethrough yarn-severing means;

operating said yarn-severing means through said access to sever said yarn into bits;

tufting by moving said needles to apply said yarn bits to said backing layer; and closing said access to render effective said pneumatic means.

4. In a tufting machine for forming tufts on a backing:

reciprocable bit-applying elements movable through the backing toward and from a yarn engaging position;

pneumatic yarn-transporting means extending to said bit-applying elements, said pneumatic means including passageways through which yarn is transported to said bit-applying elements, said passageways being separable to create an opening;

means to open and close said opening;

strand-severing means operable through said opening;

means for operating said strand-severing means through said opening repeatedly to cut said yarn strands and means for operating said bit-applying elements from said yarn engaging positions through said backing, to form tufts.

5. In a tufting machine for applying bits of yarn to a backing:

reciprocable bit-applying means movable with respect to the backing toward and from a loading position;

pneumatic yarn-transporting means extending transversely of said bit-applying means for repeatedly loading said bit-applying means with tufting yarn upon successive movements of said bit-applying means to said loading position, said pneumatic means including passageways through which yarn strands are transported, said passageways including a reciprocable section;

means connected to said reciprocable section repeatedly to create an access to said passageways and to close same;

strand-severing means adjacent said loading position and operable through said access;

means for operating said strand-severing means through said access for repeatedly severing said yarn strands into bits; and means for operating said bit-applying means for applying said bits to the backing.

6. In a tufting machine for forming tufts on a backing:

reciprocable bit-applying means movable with respect to the backing toward and from a loading position;

pneumatic yarn-transporting means extending transversely of said bit-applying means for repeatedly loading said bit-applying means with tufting yarn upon successive movements of said bit-applying means to said loading position, said pneumatic means including passageways through which yarn strands are fed, said passageways including a shiftable section;

means for driving said shiftable section repeatedly to create and eliminate an access extending across at least part of said passageways;

strand-severing means adjacent said loading position and operable through said access repeatedly to sever said yarn strands into bits;

means for changing the location of said shiftable section relative to said bit-applying means to provide yarn bits of different lengths; and means for operating said bit-applying means for applying said bits to the backing.

7. A tufting machine for applying bits of yarn to a backing, comprising:

reciprocable bit-applying means movable with respect to the backing toward and from a loading position;

pneumatic yarn-transporting means extending transversely of said bit-applying means for repeatedly loading said bit-applying means with tufting yarn upon successive movements of said bit-applying means to said loading position, said pneumatic means including passageways through which yarn strands are fed, said passageways extending through a shiftable section;

means for operating said shiftable section repeatedly to open and close a gap extending across at least part of said passageways, said passageways including one or more flexible portions to facilitate said shifting;

strand-severing means operable repeatedly through said gap to sever said yarn strands into bits; and means for operating said bit-applying means for applying said bits to the backing.

8. A tufting machine for forming tufts on a backing comprising:

reciprocable bit-applying means movable with respect to the backing toward and from a loading position;

pneumatic yarn-transporting means extending transversely of said bit-applying means for repeatedly loading said bit-applying means with tufting yarn upon successive movements of said bit-applying means to said loading position, said pneumatic means including passageways through which yarn strands are transported, said passageways extending through a reciprocable section;

driving means connected to said reciprocable section repeatedly to open and close a gap extending across at least a part of said passageways, said passageways further including telescoping members to permit the reciprocation of said reciprocable section;

strand-severing means and operable through said gap repeatedly to cut said yarn strands into bits; and means for operating said bit-applying means from said loading position to a tufting position for applying said bits to the backing.

9. In a tufting machine for forming tufts on a backing having reciprocable bit-applying means movable with respect to the backing toward and from a loading position the combination of:

pneumatic yarn-transporting means extending transversely of said bit-applying means said pneumatic means including passageways through which yarn is transported, said passageways being axially separable to open and close a gap extending across each said passageway;

means for axially moving said passageways repeatedly to open and close said gaps;

strand-severing means aligned for operation through said gaps repeatedly to sever said yarn strands to form bits for said bit-applying means; and means for operating said bit-applying means to apply said bit-lengths to the backing

10. In a tufting machine for forming tufts on a backing having reciprocable bit-applying means movable with respect to the backing toward and from a loading position, the combination of:

pneumatic yarn-transporting means extending transversely of said bit-applying means for repeatedly loading said bit-applying means with tufting yarn strands upon successive movements of said bit-applying means to said loading position, said pneumatic means including passageways through which yarn is transported, said passageways being axially separable to open and close a gap extending across said passageways;

means for axially moving said passageways repeatedly to open and close said gaps;

strand-severing means adjacent said loading position operable through said gaps repeatedly to cut said yarn strands to form bits;

bit-clamping means to hold said bits in fixed position relative to said bit-applying means prior to their application to said backing; and means for operating said bit-applying means to apply said bits to the backing.

11. In a tufting machine for forming tufts on a backing having reciprocable bit-applying means movable with respect to the backing toward and from a loading position the combination of:

pneumatic yarn-transporting means extending transversely of said bit-applying means said pneumatic means including passageways through which yarn is transported, said passageways being axially separable repeatedly to open and close a gap extending across said passageways;

means for axially moving said passageways repeatedly to open and close said gaps;

strand-severing means disposed for operation through said gaps repeatedly to cut yarn bits; and means for repeatedly operating said bit-applying means once loaded with a bit of yarn to apply said bits to the backing to form tufts.

12. A tufting machine for forming tufts on a backing, comprising:

reciprocable bit-applying means movable with respect to the backing from a loading position to a tuft-applying position;

pneumatic yarn-transporting means for repeatedly loading said bit-applying means with tufting yarn upon successive movements of said bit-applying means to said loading position, said pneumatic means including passageways through which yarn strands are transported, said passageways extending through a shiftable section which is shiftable to open and close access to said passageways;

means driving said shiftable section repeatedly to open and close said access;

strand-severing means operable through said access repeatedly to cut said yarn into bits;

means for repeatedly operating said bit-applying means from said loading position to a bit-applying position for applying said bits to the backing;

clearing means movable from a tuft-receiving position to a tuft-removing position; and driving means for driving said clearing means after each operation of said bit-applying means to its tuft-applying position to clear the tufts from the paths of the bit-applying means in their next operation to said tuft-applying position.

13. A tufting machine for forming tufts on a backing comprising:

reciprocable bit-applying elements movable from a loading position through the backing to a tuft-applying position;

pneumatic yarn-transporting means;

means including said pneumatic means for repeatedly loading said bit-applying elements with yarn strands upon successive movement of said bit-applying elements to said loading position;

strand-severing means operable in conjunction with said pneumatic yarn-transporting means to cut said yarn strands to form yarn bits;

driving means for operating said bit-applying elements between their loading and tuft-applying positions so as to apply said bits to the backing to form tufts;

means for moving the backing after each tuft-applying operation to expose to said bit-applying elements an untufted portion of said backing;

a tuft-retaining bar positioned to retain said tufts away from the paths of said bit-applying elements during at least a part of their succeeding tuft-applying operation; and means operable after each tuft-applying operation of said bit-applying elements for guiding the applied tufts to the far side of said tuft-retaining bar away from the paths of said bit-applying elements.

14. A tufting machine for forming tufts on a backing comprising:

reciprocable bit-applying elements movable through the backing toward and from a tufting position;

means including pneumatic yarn-transporting passageways for repeatedly loading said bit-applying elements with yarn strands upon successive movement of said bit-applying elements from said tufting position;

strand-severing means operable in conjunction with said pneumatic yarn-transporting passageways to sever said yarn strands to form yarn bits;

means for operating said bit-applying elements for applying said bits by said bit-applying elements to the backing to form tufts;

a tuft-retaining bar positioned out of the path of said bit-applying elements to retain said tufts applied to the backing away from the paths of succeeding operations of said bit-applying elements; and reciprocable backing support means which moves tufts from the path of succeeding operations of said bit-applying elements and deposits said tufts to the side of said tuft-retaining bar remote from the path of said bit-applying elements.

15. A tufting machine for forming tufts on a backing comprising:

reciprocable bit-applying means movable with respect to the backing toward and from a loading position;

driving means for said bit-applying means;

means including pneumatic yarn-transporting passageways for repeatedly loading said bit-applying means with tufting yarn upon successive movements of said bit-applying means to said loading position, said passageways in part comprising an axially reciprocable section;

driving means connected to said reciprocable section repeatedly to open and close an access to said passageways;

means for moving said access a selectable distance from said loading position;

cutting means having a cutting element and an anvil positioned on opposite sides of said access, whereby movement of said cutting element through said access and against said anvil severs a bit from said tufting yarn;

means positioning said cutting means a selectable distance from said loading position to provide a yarn bit of selectable length; and means for operating said bit-applying means so as to apply said bits of said selectable length to the backing to form tufts.

16. In a tufting machine having bit-applying elements, pneumatic means including passageways for flow of gas therethrough to deliver strands of yarn to said bit-applying elements, said passageways extending to said bit-applying elements respectively, said passageways having a first part shiftable relative to a second part, the method of tufting comprising the steps of:

transporting yarn strands by pneumatic means through passageways to a loading position with respect to bit-applying elements;

shifting a first part of each of said passageways relative to a second part of that passageway to provide an access to the passageway;

operating a yarn-severing means through each said access to sever said strand to leave a bit in a loading position relative to a bit-applying element;

tufting by moving the bits of yarn into tufting relationship with a backing layer with said bit-applying elements; and clearing tufts from the paths of said bit-applying elements in their next tufting operation.

17. A tufting machine including bit-applying means for applying tufts to a backing layer and further including yarn feeding apparatus comprising:

tubular means forming a passageway extending between a source of yarn and a use-location for the yarn;

means flow-connected to said passageway for producing a flow of air or other gas in the direction of said use-location for transport of yarn along said passageway;

said tubular means having structure relatively movable to open and to close an access to said passageway; and yarn severing means operable through said access to sever a length of yarn from said source of yarn.

18. A tufting machine including bit-applying means for applying tufts to a backing layer and further including yarn feeding apparatus comprising:

tubular means forming a passageway extending between a source of yarn and said bit-applying means;

means flow-connected to said passageway for producing a flow of air or other gas in the direction of said bit-applying means for transport of yarn along said passageway;

said tubular means having structure relatively movable to open and to close an access to said passageway; and yarn severing means operable through said access to sever a predetermined length of yarn from said source of yarn.

19. A tufting machine including bit-applying means for applying tufts to a backing layer and further including yarn feeding apparatus comprising:

tubular means forming a passageway extending between a source of yarn and a use-location for the yarn;

means flow-connected to said passageway for producing a flow of air or other gas in the direction of said use-location for transport of yarn along said passageway;

said tubular means having structure relatively movable to open and to close an access to said passageway; and yarn-severing means operable through said access to sever a length of yarn from said source of yarn before, during or after said yarn reaches said use-location.

20. A tufting machine including bit-applying means for applying tufts to a backing layer and further including yarn feeding apparatus comprising:

tubular means forming a passageway extending between a source of yarn and a use-location for the yarn;

means flow-connected to said passageway for producing a flow of air or other gas in the direction of said use-location for transport of yarn along said passageway;

said tubular means having structure a part of which is flexible to facilitate relative motion of at least one part of said passageway to open and to close an access to said passageway; and yarn-severing means operable through said access opening to sever a length of yarn from said source of yarn.

21. A tufting machine including bit-applying means for applying tufts to a backing layer and further including yarn feeding apparatus comprising:

tubular means forming a passageway extending between a source of yarn and a use-location for the yarn;

means flow-connected to said passageway for producing a flow of air or other gas in the direction of said use-location for transport of yarn along said passageway;

said tubular means having telescopic structure to facilitate relative motion of at least one part of said passageway thereby opening an access to said passageway; and yarn-severing means operable through said access to sever a length of yarn from said source of yarn.

22. A tufting machine including bit-applying means for applying tufts to a backing layer and further including yarn feeding apparatus comprising:

tubular means forming a passageway extending between a source of yarn and a use-location for the yarn;

means flow-connected to said passageway for producing a flow of air or other gas in the direction of said use-location for transport of yarn along said passageway;

said tubular means having structure relatively movable in opening and closing an access to said passageway; and yarn-severing means operable through said access to sever a length of yarn from said source of yarn, the position of said yarn-severing element being adjustable to sever yarn of selectable lengths.

23. A tufting machine including bit-applying means for applying tufts to a backing layer, the improvement comprising yarn feeding apparatus having:

tubular means forming a passageway extending between a source of yarn and a use-location for the yarn;

means flow-connected to said passageway for producing a flow of air or other gas in the direction of said use-location for transport of yarn along said passageway;

said tubular means having structure relatively movable in opening and closing an access to said passageway;

yarn severing means operable through said access to sever a length of yarn from said source of yarn; and means to prevent movement of said severed length of yarn in a direction parallel to said gas flow.

24. The tufting machine of claim 23 wherein said means to prevent movement of said length of yarn comprises a clamp means.

25. The tufting machine of claim 23 wherein said means to prevent movement of said length of yarn comprises a stop abutment means.

26. Yarn feeding apparatus comprising:

tubular means forming a passageway extending between a source of yarn and reciprocating a bit-applying element for forming tufts on a backing layer;

means flow-connected to said passageway for producing a flow of air or other gas in the direction of said use-location for transport of yarn along said passageway;

said tubular means having structure relatively movable to open and to close an access opening of said passageway;

means including a yarn severing element operable through said access opening to sever a length of yarn from said source of yarn for use by said bit-applying element;

means for operating said bit-applying element to apply yarn lengths to the backing to form tufts; and clearing means operable to clear at least some of said tufts from the paths of succeeding bit-applying element strokes.

27. Yarn feeding apparatus comprising:

tubular means forming a passageway extending between a source of yarn and a bit-applying element for forming tufts on a backing layer, means flow-connected to said passageway for producing a flow of air or other gas in the direction of said use-location for transport of yarn along said passageway;

said tubular means having structure relatively movable to open and to close an access opening of said passageway;

means including a yarn-severing element operable through said access opening to sever a length of yarn from said source of yarn to supply said bit-applying element;

means for operating said bit-applying element to apply yarn lengths to the backing to form tufts;

tuft guiding means to deflect at least some of said tufts from the paths of succeeding bit-applying element strokes; and tuft-retaining means to retain said deflected tufts from the paths of succeeding bit-applying element strokes.

28. A tufting machine including bit-applying means for applying tufts to a backing layer further including yarn feeding apparatus comprising:

a passageway extending between a source of yarn and a use-location for the yarn;

means flow-connected to said passageway for producing a flow of air or other gas in the direction of said use-location for transport of yarn along said passageway;

said passageway having a portion which is movable to expose the yarn; and yarn-severing means operable to sever a length of yarn from said exposed yarn.

29. In a tufting machine having at least one bit-applying element, pneumatic means including at least one passageway for flow of gas therethrough to deliver a strand of yarn to said bit-applying element, said passageway being shiftable, the method of tufting comprising the steps of:

applying a flow of gas to said yarn strand to move said strand through said passageway;

shifting said passageway to provide access to said strand;

applying a yarn-severing means when said access is provided to cut said strand; and closing said access by further shifting said passageway to render effective said flow of gas.

* * * * *

UNITED STATES PATENT OFFICE

CERTIFICATE OF CORRECTION

Patent No. 3,937,156 Dated February 10, 1976

Inventor(s) Abram N. Spanel

It is certified that error appears in the above-identified patent and that said Letters Patent are hereby corrected as shown below:

Column 2, line 7, delete "system" and insert --systems--.

Column 2, line 58, insert before "cutting" --metering means and the--.

Column 4, line 28, after "loading station" insert --20--.

Column 4, line 42, delete "y" and insert --Y--.

Column 7, line 34, after "to" insert --its--.

Column 11, line 47, delete "bit-lengths" and insert --bits--.

Signed and Sealed this

Twentieth Day of July 1976

[SEAL]

*Attest:*

RUTH C. MASON
*Attesting Officer*

C. MARSHALL DANN
*Commissioner of Patents and Trademarks*